US005624023A

United States Patent [19]

Chasen et al.

[11] Patent Number: 5,624,023

[45] Date of Patent: Apr. 29, 1997

[54] METHOD FOR SELECTIVELY CONNECTING AN ELECTRIC IRON TO A SOURCE OF ELECTRICAL POWER

[75] Inventors: James Chasen, West Haven; Paul DeMarseilles, Branford; George Drizos, Cheshire, all of Conn.; Tim Cronin, San Francisco, Calif.

[73] Assignee: Black & Decker Inc., Newark, Del.

[21] Appl. No.: 560,066

[22] Filed: Nov. 17, 1995

Related U.S. Application Data

[63] Continuation of Ser. No. 181,634, Jan. 13, 1994, Pat. No. 5,493,089.

[51] Int. Cl.[6] ..... H01H 13/58

[52] U.S. Cl. ..... 200/526; 200/523

[58] Field of Search ..... 200/523, 526, 200/292, 520, 533, 534, 524, 39 R, 39 A, 40; 361/202, 199; 219/240, 250, 251, 252, 253, 241; 335/6, 14, 15, 20, 21

[56] References Cited

U.S. PATENT DOCUMENTS

| | | | |
|---|---|---|---|
| 2,703,348 | 3/1955 | Knapp et al. . | |
| 3,564,279 | 2/1971 | Strathearn . | |
| 3,715,694 | 2/1973 | Kruger . | |
| 3,728,659 | 4/1973 | Brock . | |
| 3,902,159 | 8/1975 | Parolin . | |
| 3,965,311 | 6/1976 | Parolin . | |
| 4,272,747 | 6/1981 | Bauer . | |
| 4,319,106 | 3/1982 | Armitage . | |
| 4,382,241 | 5/1983 | Hehl . | |
| 4,515,518 | 5/1985 | Gilbert et al. . | |
| 4,578,732 | 3/1986 | Draper et al. . | |
| 4,590,449 | 5/1986 | VanTielen . | |
| 4,604,597 | 8/1986 | Bogner et al. . | |
| 4,641,216 | 2/1987 | Morris et al. . | |
| 4,695,016 | 9/1987 | Worack . | |
| 4,823,109 | 4/1989 | Boyer . | |
| 4,862,123 | 8/1989 | Gray et al. . | |
| 4,990,875 | 2/1991 | Lemarguand et al. | 335/14 |
| 5,300,905 | 4/1994 | Kolbas et al. | 335/6 |

*Primary Examiner*—David J. Walczak
*Attorney, Agent, or Firm*—Barry E. Deutsch

[57] ABSTRACT

An electric iron has a printed circuit board mounted to a rear wall in the iron's housing. An operating switch is mounted on the circuit board. The operating switch connects the iron to a source of electrical power when moved by a first manual force and disconnects the iron from the source of electrical power when moved by a second manual force or moved responsive to energization of a solenoid winding.

2 Claims, 4 Drawing Sheets

METHOD FOR SELECTIVELY CONNECTING AN ELECTRIC IRON TO A SOURCE OF ELECTRICAL POWER

This is a continuation of application Ser. No. 08/181,634 filed on Jan. 13, 1994, now U.S. Pat. No. 5,493,089.

BACKGROUND OF THE INVENTION

This invention relates to an electric iron and, in particular, to a switch for the electric iron that can selectively connect and disconnect the electric iron to a source of electrical power.

Switch assemblies to activate an electric iron are very often retained in a cavity defined by the handle. When so disposed, the longevity of the switch may be reduced due to the somewhat hostile heat, vapor and electrical environment existing within the cavity. Further, since the cavity is rather confined and relatively separated from the main power terminals, it is often difficult to effectively connect the switch to other electrical components typically found in many modern irons and to the source of electrical power. Some irons have partially overcome the hostile iron environment problem by placing some electrical components under the rear cover. The rear of the iron is subject to less electrostatic discharge and is somewhat less hostile, particularly as exposure of the electrical electrical components to steam is reduced. The rear mounted electrical components also require less electrical wiring for connection to the source of electrical power.

Moreover, many present irons include electrical means which automatically turn an iron off after a lack of iron motion for a predetermined period of time. Some of these irons include a switch to initially electrically connect the iron to a source of power, while other of the irons require that the user shake the iron to restart it after it has been turned off for lack of motion. Neither of these types of irons include a switch which may be used by the user to manually turn the iron on and off and which can also be turned off automatically upon lack of iron motion.

Accordingly, it is an object of this invention to provide a control system and switch for an electric iron which will enable the user to manually turn the iron on or off and which can also be automatically turned off upon lack of iron motion for a predetermined period of time to disconnect the iron from its source of power. Further, the switch may be readily mounted on a printed circuit board which may be connected as a modular unit beneath the rear cover of the iron.

SUMMARY OF THE INVENTION

The foregoing object and other objects of the present invention are attained in a control system for selectively connecting and disconnecting an electric iron to a source of electrical power including a printed circuit board mounted to a rear wall of a housing of the iron. An operating switch is mounted on the circuit board and includes a drive member movable in response to a force applied thereto. An operating knob extends through the housing in close proximity to the rear wall and is connected to the drive member for enabling an iron user to apply a manual force on the drive member. The system further includes a pair of spaced electrical contacts and an electrical conductor movably positioned relative to the pair of contacts for selectively completing an electrical circuit therebetween when in engagement therewith. An electrical force applying means is electrically connected to the drive member and includes means for energizing the electrical force applying means to apply an electrical force on the drive member. Means connect the drive member to the conductor for moving the conductor relative to the contacts in response to movement of the drive member. The drive member moves the conductor into engagement with the contacts in response to the application of a first manual force on the member through the operating knob and the drive member moves the conductor out of engagement with the contacts alternatively in response to the application of an electrical force thereto by the electrical force applying means or in response to the application of a second manual force through the operating knob.

DESCRIPTION OF THE PREFERRED EMBODIMENT

Figure 1:
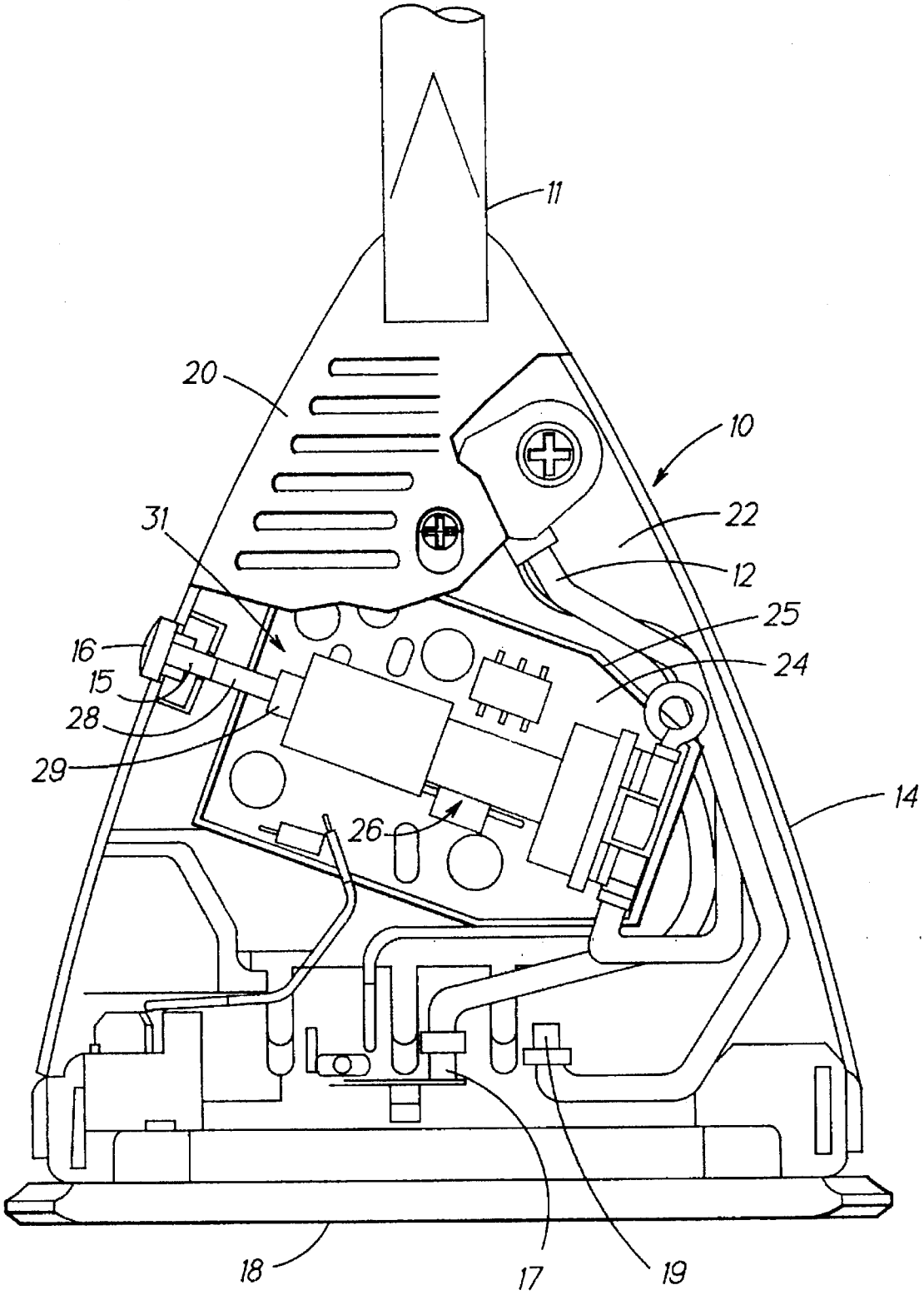
FIG. 1 is an end elevational view of the rear portion of an electric iron embodying the present invention.
Figures 2, 3:
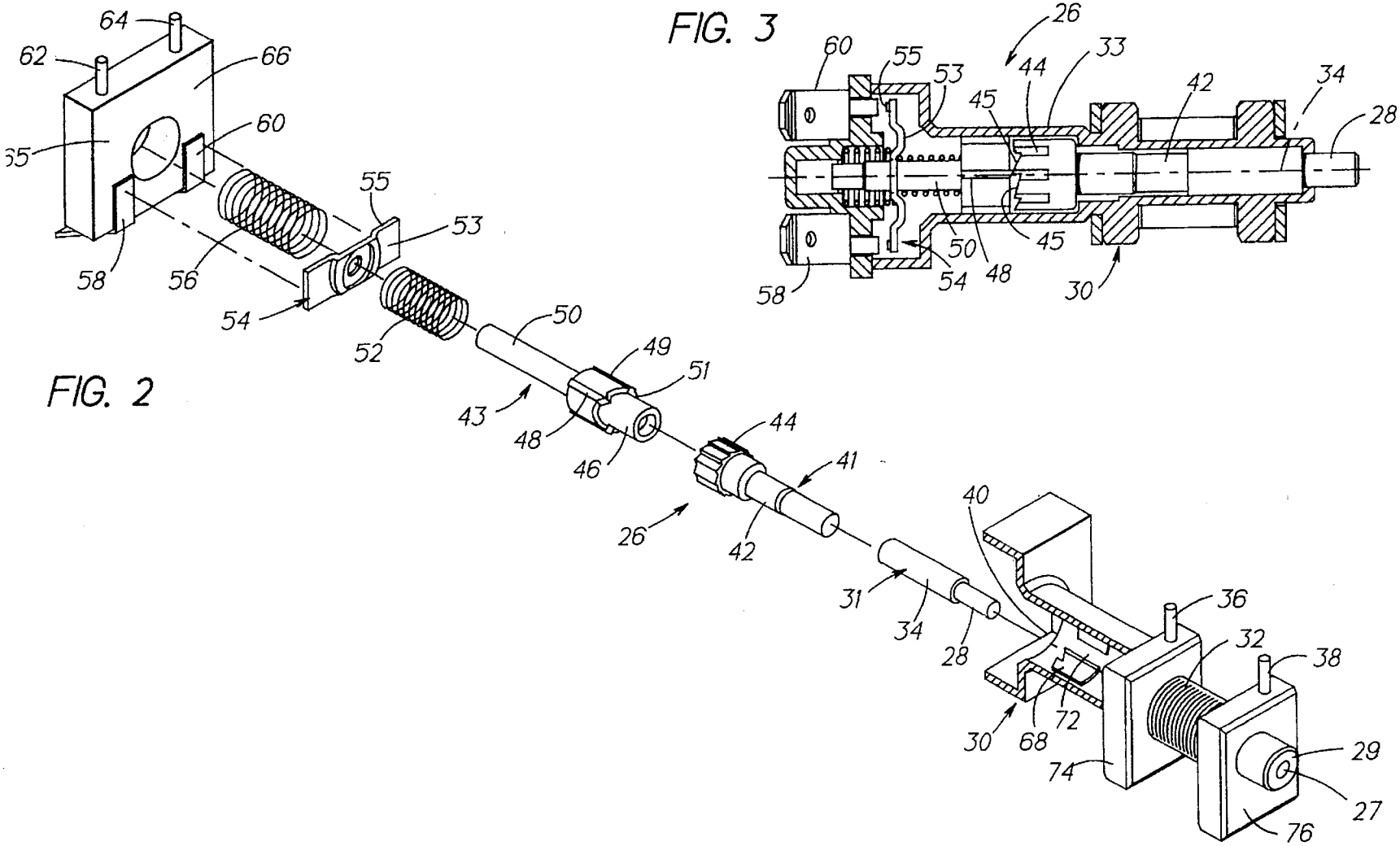
FIG. 2 is an exploded perspective view of the switch assembly of the present invention.
FIG. 3 is a sectional view of the switch assembly, with portions omitted for sake of clarity.

Referring now to the various figures of the drawing, there is disclosed a preferred embodiment of the present invention. In referring to the various figures of the drawing, like numerals shall refer to like parts.

Referring specifically to FIG. 1, there is disclosed an end elevational view of an iron 10 embodying the present invention. Iron 10 includes a housing 14. The iron has a rear cover 20 which is connected to an end wall 22 of the iron and forms a space therebetween. The iron is connected to a source of electrical power through power supply cord 12. A cord bushing 11 protects power cord 12 at the entry point for the cord between wall 22 and cover 20.

Iron 10 includes a soleplate 18. Reference numerals 17 and 19 represent the termination points which lead to a U-shaped resistance heater of a type typically found in electric irons.

A control knob or button 16 extends through the rear portion of housing 14 and lies in a generally horizontal plane. Control knob 16 is operably connected to drive member 31 of an on/off control switch 26 to be more fully described hereinafter. Switch 26 is mounted on a printed circuit board 24 which is entrapped in the space formed between cover 20 and rear iron wall 22. Printed circuit board 24 is snapped into a suitable potting frame 25. Thereafter a potting compound is used to encapsulate the electric components on board 24. The frame is then connected to rear wall 22.

Referring now to FIGS. 2–6, there is shown a preferred embodiment of switch 26. Switch 26 includes a non-conductive housing 30 formed from suitable plastic or other similar material. Housing 30 includes a pair of rectangularly shaped spaced housing blocks 74 and 76 for mounting terminal pins 36 and 38 respectively. Terminal pins 36 and 38 are connected to board 24. An electrically conductive winding 32 is supported within the space between housing members 74 and 76. Each end of winding 32 is connected to a respective terminal 36 or 38 so that when electrical power is supplied to the terminal winding 32 is energized.

A nose piece 29 extends outwardly from housing member 76. Nose piece 29 has a bore 27 extending therethrough. A metallic drive member 31 extends within bore 27. Drive member 31 includes a first cylindrical portion 28 and a second cylindrical portion 34 of a somewhat larger diameter than portion 28. As shown in FIG. 1, cylindrical portion 28 of drive member 31 abuts stem 15 of control knob 16 and is therefore movable within bore 27 in response to movement of control knob 16.

Housing 30 includes a generally axially extending cylindrical portion 33 defining a bore 40. A plurality of spaced ribs 68 are formed about the circumference of the inner wall of housing 30 defining bore 40. Adjacent ribs 68 are spaced to form axially extending channels 72.

Drive member 31 abuts a cylindrical portion 42 of a first ratchet member 41. Ratchet member 41 includes a plurality of axially extending, circumferentially spaced raised ribs 44 each of which terminates in an angled surface 45 (shown in FIG. 3). Ratchet member 41 includes a central bore (not shown) within the portion of member 41 having ribs 44 formed thereon.

Switch assembly 26 includes a second ratchet member 43. Member 43 includes a cylindrical portion 46 extending towards member 41. Portion 46 is disposed within the bore of member 41 when switch assembly 26 is assembled. Ratchet member 43 includes a plurality of axially extending raised ribs 48 which are circumferentially spaced about the surface of member 43. Surfaces 49 join adjacent ribs 48. Each surface 49 terminates in a concave face 51. Member 43 includes a second axially extending cylindrical portion 50.

A compression spring 52 is supported upon cylindrical portion 50 of ratchet member 43. Spring 52 abuts a first face 53 of shunt washer 54. The end of cylindrical portion 50 passes through washer 54 to permit springs 52 and 56 to be supported thereon. Washer 54 includes a second face 55. A second compression spring 56 abuts face 55 and is captured between face 55 and a face 65 of generally rectangularly shaped end cap 66. End cap 66 includes a pair of terminals 62 and 64 which connect the end cap to the circuit formed on printed circuit board 24. End cap 66 also includes a pair of main terminals 58 and 60 which are connected to the source of electrical power delivered to the iron via supply cord 12.

Figure 7:
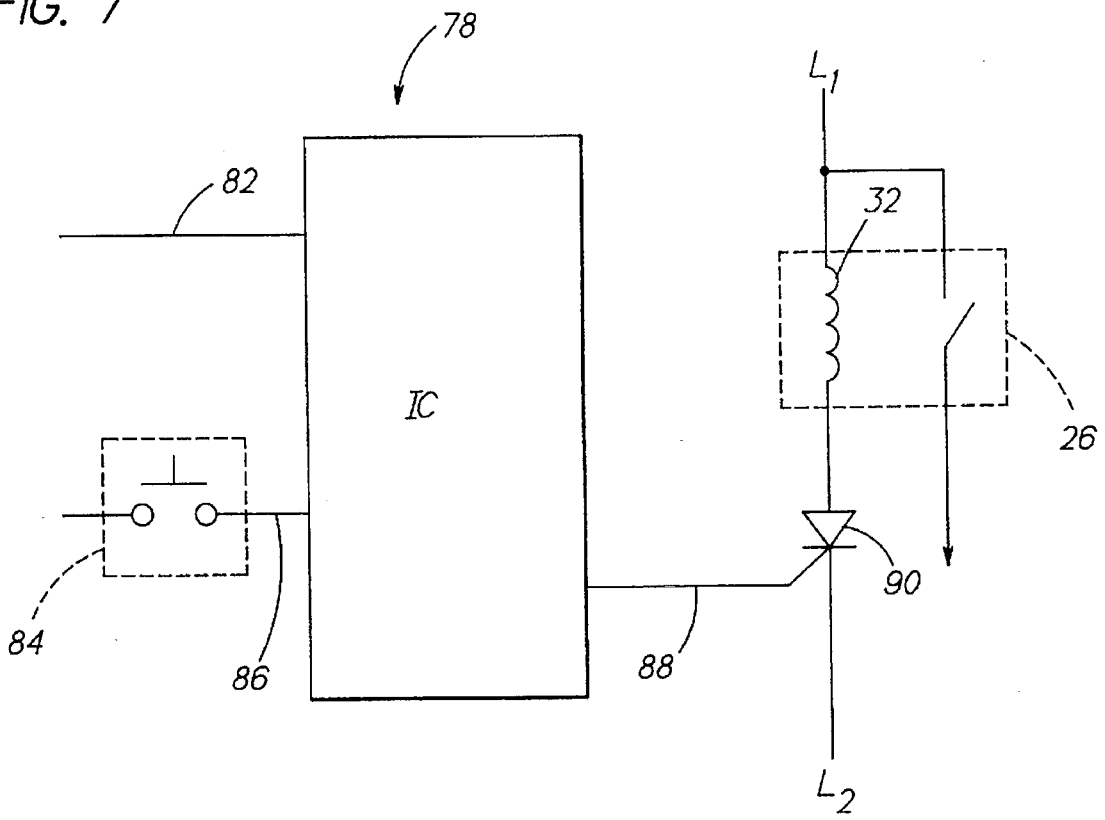
FIG. 7 is a schematic illustration of an electrical circuit for the iron embodying the present invention.

As shown in FIG. 7, switch 26 is included in a supply circuit for delivering electrical power to iron 10. The source of electrical power is represented by lines L1 and L2. As shown, when switch 26 is closed, electrical power is delivered to the iron's heater and to printed circuit board 24.

Winding 32 of switch 26 is connected in series with SCR 90. SCR 90 is connected to the output of integrated circuit 78 via conductor 88. When power is delivered to the iron upon closure of switch 26, the 120 volt power supply is reduced to a low voltage supply level, for example 12 volts, and this 12 volt control signal is transmitted to an input of integrated circuit 78 via conductor 82. Integrated circuit 78 counts the oscillations of the 60 Hertz 12 volt input signal transmitted via conductor 82.

Integrated circuit 78 also receives a second input signal via conductor 86. A mercury switch 84 or similar motion sensing device controls the transmission of a control signal through conductor 86 to integrated circuit 78.

The operation of switch assembly 26 in iron 10 shall now be explained.

Figure 6:
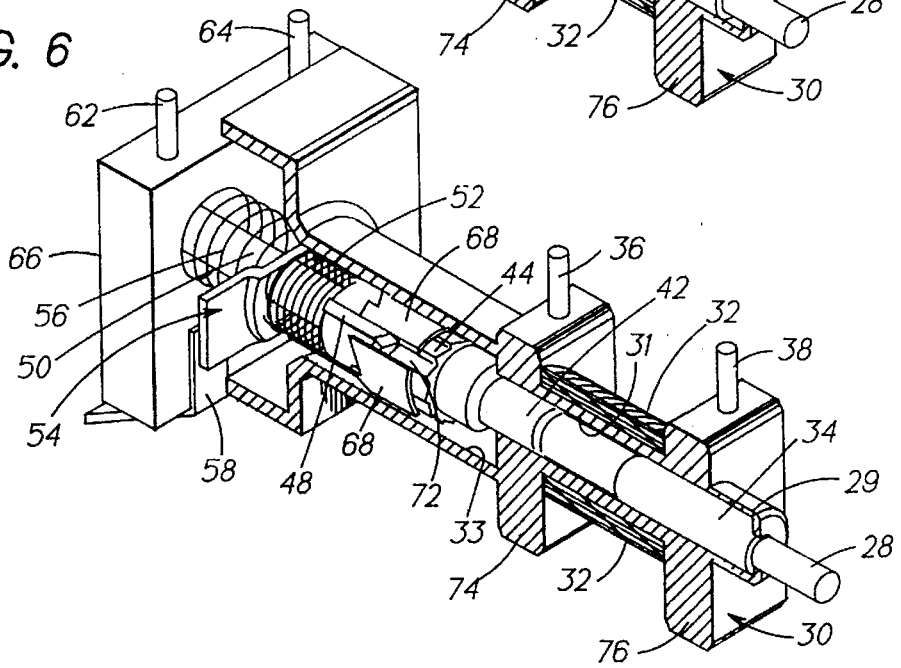
FIG. 6 is a view similar to the views shown in FIGS. 4 and 5, illustrating the switch assembly in a second operating position.

FIG. 6 illustrates the various components of switch assembly 26 when the switch is in its off position. When switch 26 is off, winding 32 is deenergized. Springs 52 and 56 are in their switch open state and shunt washer 54 is spaced from terminals 58 and 60. Each rib 48 of ratchet member 43 is disposed within a corresponding channel 72 formed between adjacent ribs 68 formed on the inside surface of housing 30 defining bore 40.

Figure 4:
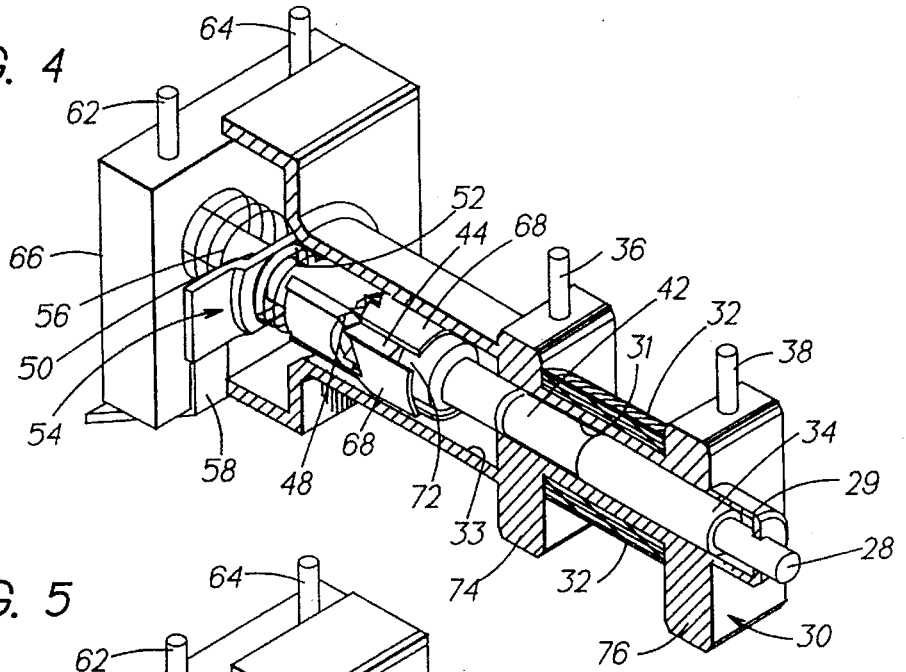
FIG. 4 is a perspective sectional view of the switch assembly, illustrating the switch assembly in a transient position.
Figure 5:
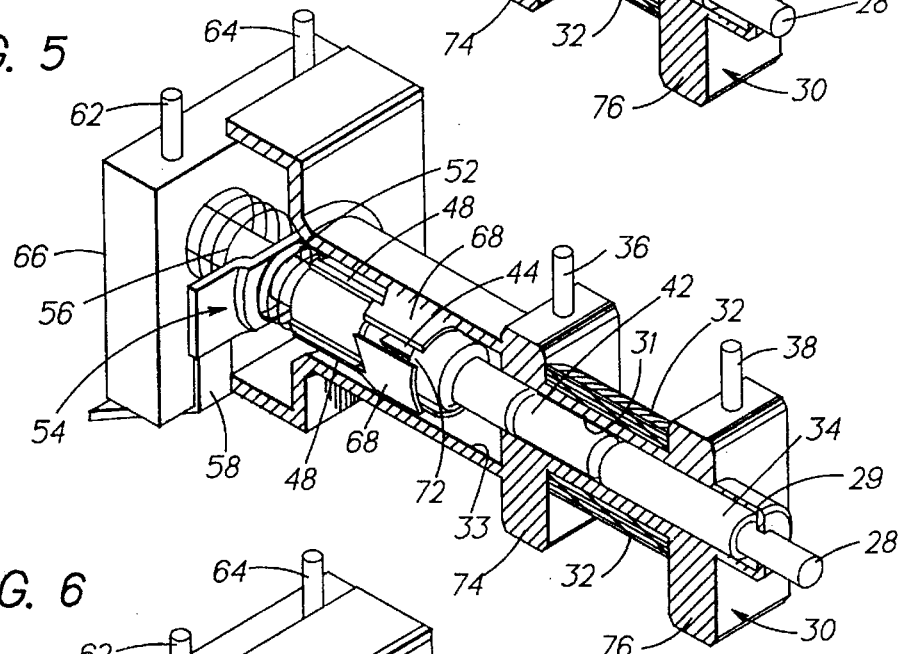
FIG. 5 is a view similar to that illustrated in FIG. 4 showing the switch assembly in a first operating position.

When a user of iron 10 desires to connect the iron to a source of electrical supply, the user depresses knob 16 which, in turn, axially moves member 31 to the left as viewed in FIGS. 4–6. Drive member 31, in turn, moves ratchet member 41 axially within bore 40 to the left. Movement of member 41 causes member 43 to likewise move to the left which compresses springs 52 and 56. Shunt washer 54 is moved into engagement with terminals 58 and 60 through the axial movement of members 28, 41 and 43 to complete an electrical circuit between the terminals and connect the iron to the source of power. FIG. 4 illustrates such movement. It should be noted that each rib 48 is moved axially with respect to a corresponding channel 72 so that the end of each rib falls outside of the channel. It also should be noted that a rib 44 of member 41 engages an end of a corresponding rib 48.

When further axial movement of members 31, 41 and 43 is prevented by springs 52 and 56 being fully compressed, the axial force developed by member 41 on member 43 is translated into a torsional force. The ends of ribs 44 and 48 that are in engagement as shown in FIG. 4 are defined by slightly pointed surfaces. As a consequence, once springs 52 and 56 have been fully compressed to limit axial movement of member 43, any further axial force applied on member 43 from member 41 will be converted into a torsional force to rotate member 43.

As viewed in FIG. 5, member 43 is rotated in a clockwise direction. Such rotational movement of member 43 results in each rib 48 being supported upon the end of a corresponding rib 68. Ribs 68 function as stops to prevent member 43 from moving axially to the right as viewed in FIGS. 4 to 6 once the axial force has been removed from members 31 and 41. Thus, when the user actuates knob 16 to turn the iron on, washer 54 is placed into engagement with terminals 58 and 60 and, although the knob returns to its non-depressed state after the user actuates the same the repositioning of member 43 relative to member 41 provides a force to continue to compress springs 52 and 56 and maintain shunt washer 54 in engagement with terminals 58 and 60.

With reference to FIG. 7, with switch 26 closed, power is supplied to the heater and printed circuit board assembly 24 of iron 10. Integrated circuit 78 receives a control signal via conductor 82 and counts the frequency of such control signals. During the normal ironing operation mercury switch 84 opens and closes and provides a reset signal via conductor 86 to integrated circuit 78. Each time integrated circuit 78 receives a reset signal from mercury switch 84 and conductor 86 it restarts counting the frequency of the control signal transmitted through conductor 82.

If, while the iron is energized, the user thereof fails to move the iron for a predetermined period of time, for example 10 minutes, the mercury switch stays in a steady state and a reset signal is not generated and transmitted via conductor 86 to circuit 78. This results in a continuous counting of the control signal transmitted through conductor 82 and, when a predetermined count is reached, an output signal is transmitted via conductor 88 to turn on SCR 90. When SCR 90 is turned on, winding 32 of switch 26 is energized.

When winding 32 is energized, it creates an electrical field to attract member 31 which moves the member to the left as viewed in FIGS. 4–6. Such movement of member 31 results in an axial force being applied to members 41 and 43.

The new axial force provided on member 43 causes the member to move axially to again compress springs 52 and 56 to their maximum and, once the springs have been so compressed any additional axial force applied on member 43 results in the member rotating. Rotation of member 43 causes each rib 48 to move from the outer face of a corresponding rib 68 into a corresponding channel 72.

Once ribs 48 have been repositioned within channels 72, member 43 moves axially to the right and the force provided by spring 56 results in shunt washer 54 moving to the right to open the circuit between terminals 58 and 60. The foregoing results in iron 10 being disconnected from its source of power. This is illustrated in FIG. 6.

Alternatively, the user may also deenergize iron 10 by again depressing knob 16 which results in member 31 being moved to the left which, in turn, results in members 43 and 54 being moved from their FIG. 5 positions to their FIG. 6 positions as described above.

The switch assembly of the present invention provides for an effective and relatively inexpensive means for enabling a user to energize or deenergize the iron. In addition, the switch may be moved to a deenergized or off position as a consequence of the iron being left motionless for a predetermined period of time. Due to its compact structure, switch assembly 26 may be readily mounted on a printed circuit board which can be connected as a modular unit in a spaced defined between rear cover 20 and end wall 22 of iron 10.

While a preferred embodiment of the present invention has been described and illustrated, the invention should not be limited thereto but may be otherwise embodied within the scope of the following claims.

What is claimed is:

1. A method for selectively connecting and disconnecting an electric iron to a source of electrical power comprising the steps of:

activating a control switch by selectively applying a first manual force thereto to connect the electric iron to the source of electrical power;

deactivating the control switch by selectively applying a second manual force thereto to disconnect the iron from the source of electrical power;

alternatively disconnecting the iron from the source of electrical power by generating an electric control signal to disengage an electrical conductor of the iron from electrical contacts electrically connected to said source of electrical power; and generating the control signal in response to non-use of the iron for a predetermined period of time.

2. A method in accordance with claim 1 wherein the control signal is generated from a source of electric power.

* * * * *